United States Patent [19]

Hogervorst

[11] 4,318,641

[45] Mar. 9, 1982

[54] METHOD FOR SECURING A TUBULAR ELEMENT TO THE BOTTOM OF A BODY OF WATER AND APPARATUS FOR CARRYING OUT THIS METHOD

[75] Inventor: Johannes R. Hogervorst, Rijswijk, Netherlands

[73] Assignee: Shell Oil Company, Houston, Tex.

[21] Appl. No.: 99,240

[22] Filed: Nov. 30, 1979

[30] Foreign Application Priority Data

Dec. 4, 1978 [GB] United Kingdom ..... 47094/78

[51] Int. Cl.[3] ..... E02D 7/00; E02D 29/00

[52] U.S. Cl. ..... 405/224; 114/296; 405/172; 405/228

[58] Field of Search ..... 405/224, 226, 227, 228, 405/249, 191, 172; 114/295, 296

[56] References Cited

U.S. PATENT DOCUMENTS

| | | | |
|---|---|---|---|
| 3,263,641 | 8/1966 | Stimson | 114/296 |
| 3,431,879 | 3/1969 | Westling | 405/224 X |
| 3,496,900 | 2/1970 | Mott et al. | 405/224 X |
| 3,817,040 | 6/1974 | Stevens | 405/228 |
| 3,928,982 | 12/1975 | Lacroix | 405/224 |
| 4,036,161 | 7/1977 | Nixon | 405/226 X |
| 4,215,544 | 8/1980 | Stanwick | 405/191 X |

FOREIGN PATENT DOCUMENTS

| | | | |
|---|---|---|---|
| 2247377 | 5/1975 | France | 114/296 |

*Primary Examiner*—David H. Corbin

[57] ABSTRACT

A method and apparatus for securing a tubular element to the bottom of a body of water, comprising the steps of lowering the tubular element from the watersurface to the waterbottom, removably securing the pumping unit to the tubular element either before or after the lowering of the tubular element, closing the tubular element at the upper end, reducing the pressure within the tubular element by operating the pumping unit, so as to cause the tubular element to penetrate into the waterbottom to a desired depth. Subsequently, the operation of the pumping unit is stopped and the pumping unit is disconnected from the tubular element and raised to the watersurface to recover it.

5 Claims, 9 Drawing Figures

METHOD FOR SECURING A TUBULAR ELEMENT TO THE BOTTOM OF A BODY OF WATER AND APPARATUS FOR CARRYING OUT THIS METHOD

The invention relates to a method for securing a tubular element to the bottom of a body of water and to apparatus for carrying out this method.

BACKGROUND OF THE INVENTION

It is often desirable to secure a tubular element to the waterbottom in order to use it for the anchoring of various structures, such as for example floating drilling platforms, floating production platforms, floating tension leg platforms, various types of ships and single buoy mooring systems for loading and unloading tankers, or, for example, for the staying by means of guy cables of various structures, such as for example a free-standing marine conductor.

For this purpose it is well known to drive piles, for example hollow steel piles, into the waterbottom by means of known underwater pile drivers. In deep water, the driving of piles into the seabottom in this known manner is however a difficult and expensive operation.

SUMMARY OF THE INVENTION

It is an object of the invention to provide a method and apparatus for securing a tubular element to the bottom of a body of water in a simple, quick and inexpensive manner.

Therefore the method according to the invention comprises the steps of lowering a tubular element from the watersurface to the waterbottom, removably securing a pumping unit to the tubular element either before or after the lowering of the tubular element, closing the tubular element at the upper end, reducing the pressure within the tubular element by operating the pumping unit, so as to cause the tubular element to penetrate into the waterbottom to a desired depth, stopping the operation of the pumping unit, disconnecting the pumping unit from the tubular element, raising it to the watersurface and recovering it.

An apparatus for carrying out this method comprises according to the invention, a tubular element which is adapted to be closed at the upper end and which is open at the lower end, a thin cutting edge at the lower end of the tubular element, a pumping unit for varying the pressure within the tubular element, said pumping unit being adapted to be removably secured to the tubular element.

In a suitable embodiment of the invention the pumping unit is connected to the tubular element by means of a releasable coupling which is preferably adapted to be remotely controlled.

BRIEF DESCRIPTION OF THE DRAWING

The invention will now be explained with reference to the drawings relating to some possible embodiments of the invention, wherein.

DESCRIPTION OF A PREFERRED EMBODIMENT

Figure 1:
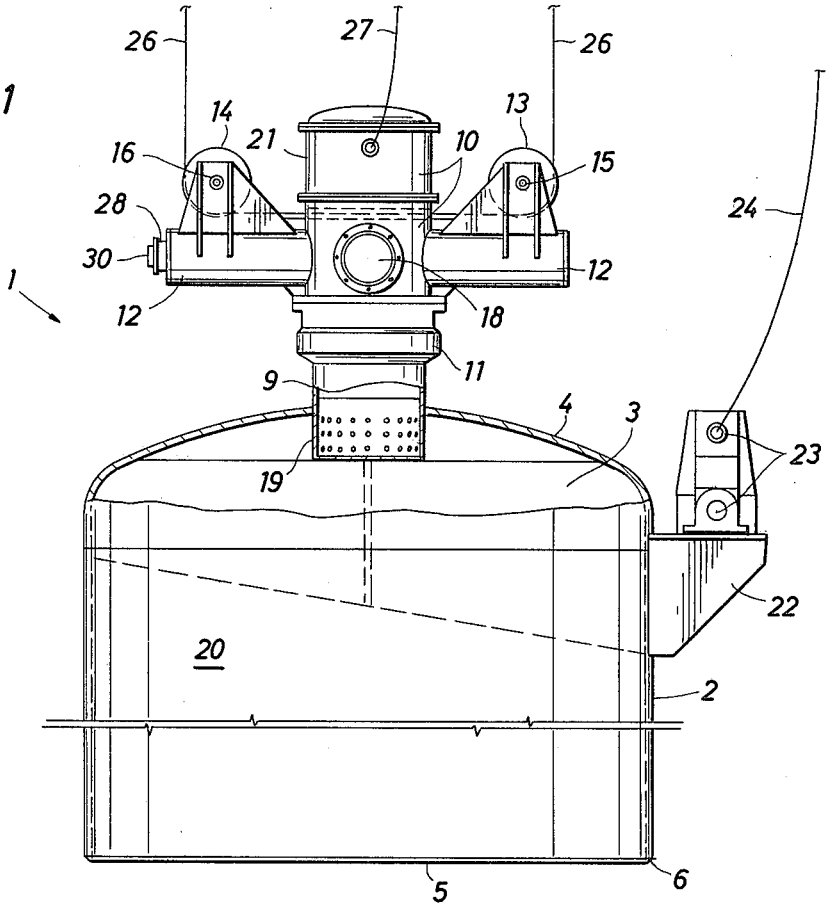
FIG. 1 shows a side view of a first embodiment of the apparatus according to the invention.
Figure 2:
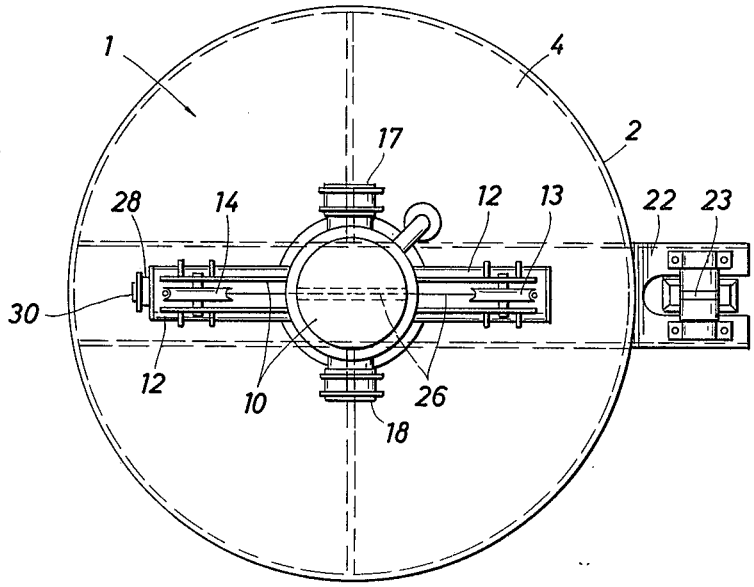
FIG. 2 shows a plan view of FIG. 1.

The embodiment of the apparatus for carrying out the method according to the invention as shown in FIGS. 1 to 6 is generally indicated by the reference numeral 1. A tubular element 2, for example made of steel, is closed at its upper end 3 by means of a cap 4. The lower end 5 of the tubular element 2 is open and is provided with a cutting edge 6 which enables the tubular element 2 to penetrate into the bottom 7 of a body of water 8.

The cap 4 is provided with a piece of pipe 9 and a pumping unit 10 is connected by means of a releasable coupling 11 to the upper end of the piece of pipe 9. The lower end of the piece of pipe 9 is provided with a sieve cap 19 for preventing ground material from reaching the pumping unit. The releasable coupling 11 can be a conventional remotely-controlled releasable coupling (for example mechanically, hydraulically, pneumatically or electrically controlled or controlled by a combination thereof).

The pumping unit 10 is provided with two radial hollow arms 12, one arm 12 carrying a sheave 13 and the other arm carrying sheave 14, and each sheave being rotatable around a corresponding axes 15 and 16, respectively, and cooperating with a hoisting cable or-chain 26. Within the left hand hollow arm 12 a pump (not shown) is arranged and within the right hand arm 12 an electric motor (not shown) is arranged for driving the pump.

Furthermore the pumping unit 10 is provided with two air release valves 17 and 18, respectively. The valves 17 and 18 are so arranged that they can open or close a communication between the interior 20 and the exterior of the tubular element 2. These valves 17 and 18 are conventional remotely controlled valves (for example hydraulically, pneumatically or electrically controlled which are actuated through lines which may be included in the power and control umbilical cable 27.

The outer surface of the tubular element 2 is provided with a radial member 22 which carries a universal joint 23 for connecting an anchor line 24 to the tubular element 2. The umbilical cable 27 is connected to the pumping unit 10 in the manner shown in the drawings to provide power and control signals thereto. The discharge of the pump is indicated by reference numeral 30 and is provided with a suitable one-way valve 28.

The installation of the tubular element 2 is carried out as follows.

From a vessel 28 the apparatus 1 is lowered by means of a hoist 29 which is provided with a hoisting cable or-chain 26. For this purpose the hoisting cable 26 is passed along the sheaves 13 and 14 and by gradually paying out the hoisting cable 26, the apparatus 1 is lowered to the bottom 7 (see FIG. 3). Before lowering the apparatus 1 to the bottom 7, the air release valves 17 and 18 are opened so that air can escape from the interior 20 of the tubular element 2 during the lowering operation.

When the cutting edge 6 contacts the bottom 7 (see FIG. 4), the hoisting line 26 is slackened somewhat so as to allow the cutting edge 6 to penetrate into the bottom 7 over a small distance under the weight of the tubular element 2 and of the pumping unit 10, in order to form a seal around the base of the tubular element 1.

Figures 3, 4, 5, 6:
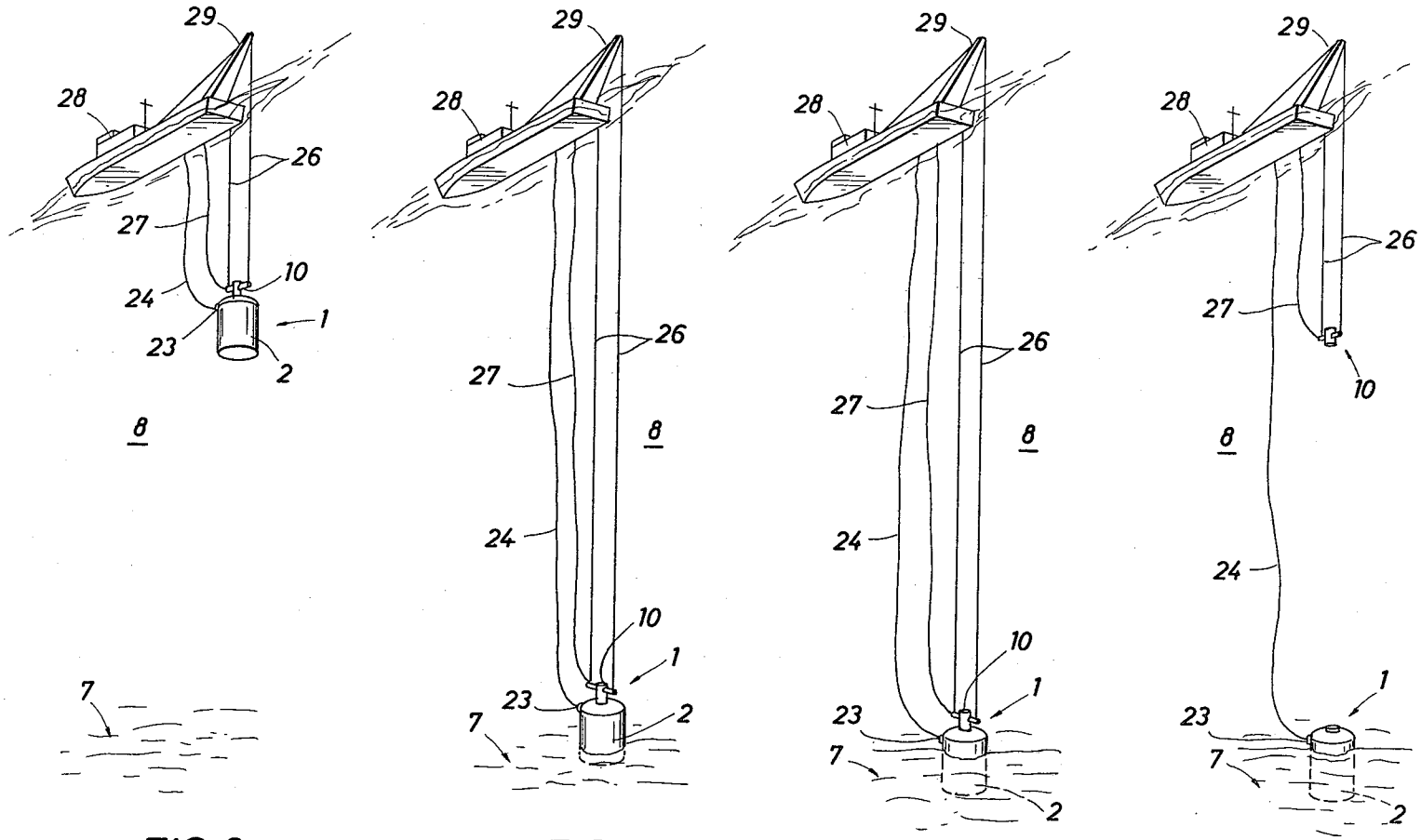
FIG. 3 is a schematic view showing the lowering of the apparatus to the bottom of a body of water.
FIG. 4 is a schematic view that shows the apparatus at the moment that it contacts the waterbottom.
FIG. 5 is a schematic view that shows the apparatus at the moment that the tubular element has penetrated about halfway into the waterbottom.
FIG. 6 is a schematic view that shows the apparatus at the moment that the tubular element has penetrated into the seabed to the desired depth.

Then the air release valves 17 and 18 are closed and the pumping unit 10 is started from the vessel 28 by means of the umbilical cable 27, which causes the pumping unit 10 to evacuate water from the interior 20 of the tubular element 2, so that the pressure within the tubular element 2 is reduced. The pumping unit 10 evacuates the water from the interior 20 via the pipe piece 9, which acts as a suction conduit and discharges the water to the exterior of the apparatus 1 via the outlet or discharge 30. In this manner a pressure difference is created between the outside and the interior of the apparatus 1. This pressure difference causes a gradual penetration of the tubular element 2 into the bottom 7 (see FIG. 5) until it has reached the final position as shown in FIG. 6.

When the tubular element 2 has reached the desired final position, which can for example be detected by divers or by means of an underwater television camera (not shown) or by means of an echo-sounder (not shown), the pumping unit 10 is switched off and then the necessary steps are taken for recovering the pumping unit 10.

For this purpose, the air release valves 17 and 18 and the releasable coupling 11 are operated by remote control via the umbilical cable 27, so that the valves 17 and 18 are opened and the pumping unit 10 is disconnected from the piece of pipe 9. Then the pumping unit 10 is raised to the water surface by hauling in the hoisting line 26 and taken aboard of the vessel 28 (see FIG. 6).

It is desirable to maintain the umbilical cable 27 and the anchor line 24 under tension during the lowering of the apparatus 1 to the waterbottom 7 to prevent tangling of the cable 27 and the line 24.

The pumping unit 10 is preferably provided with a watertight container 21 accommodating suitable measuring equipment such as an inclinometer, a differential pressure gauge and an echo-sounder or television camera to register the penetration depth of tubular element 2. By means of these instruments the progress of the installation operation can be watched and corrections can be made, if necessary.

After the installation of the tubular element 2, the anchor cable 24 can be used for mooring a floating object, for example, a vessel or a floating platform, to the tubular element 2.

Figure 7:
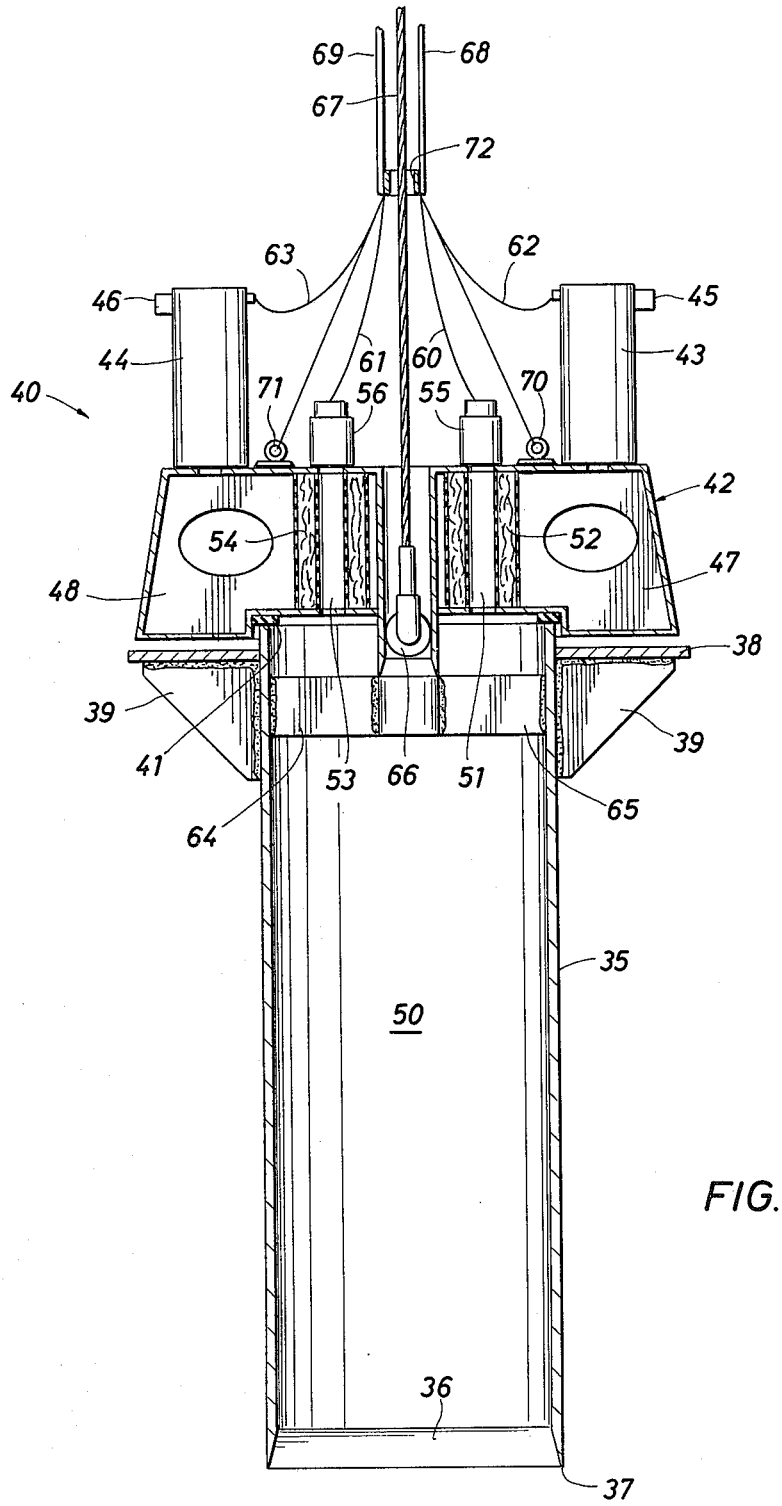
FIG. 7 is a vertical cross-section of a second embodiment of the apparatus according to the invention.

Another embodiment of the apparatus according to the invention is shown in FIG. 7.

This embodiment comprises a tubular element or pile 35, preferably made of steel. The lower end 36 of the pile 35 is open and is provided with a cutting edge 37. The tubular element 35 is furthermore provided with a radial flange 38 which is reinforced by radial webs 39. A pumping unit generally indicated by reference numeral 40 is adapted to be placed onto the top end of the tubular element 35. A sealing ring 41 is present so that a liquid tight seal can be obtained between the tubular element 35 and the pumping unit 40. The pumping unit 10 comprises a hollow main body 42 carrying two pumps 43 and 44, having outlets 45 and 46, respectively. Within the main body 42, compartments 47 and 48 are present. These compartments are in communication with the pumps 43 and 44, respectively. A communication exists between the interior 50 of the tubular element 35 and the compartment 47 via a channel 51 and an annular filter 52. Similarly a communication exists between the interior 50 and the compartment 48 via a channel 53 and an annular filter 54. Valves 55 and 56, respectively, are arranged at the end of channels 51 and 53, respectively. These valves are preferably remotely controlled, so that they can be opened or closed at will from a vessel at the watersurface. For this purpose suitable electric cables 60 and 61, respectively, lead from the valves 55 and 56, respectively, to the said vessel. Electric cables 62 and 63, respectively, lead from the pumps 43 and 44, respectively, to the vessel at the watersurface in order to switch the pumps 43 and 44 on and off as required.

Within the tubular element 35 radial webs 64 and 65 are present which carry an eye 66 which is centrally arranged within the tubular element. A first hoisting cable 67 is secured to the eye 66. An annular guide element 72 is arranged around the hoisting cable 67. Hoisting cables 68 and 69 are secured respectively to eyes 70 and 71 on the pump unit 40. The electric cables 60 and 62 are secured to or incorporated into the hoisting cable 68 and the electric cables 61 and 63 are secured to or incorporated into hoisting cable 69.

The apparatus according to FIG. 7 is installed as follows:

By means of the hoisting cable 67 the tubular element 35 is lowered from a vessel to the waterbottom. When the tubular element 35 has reached the waterbottom the cable 67 is slackened somewhat, in order to allow the cutting edge 37 to penetrate into the waterbottom under the weight of the tubular element 35. Then the valves 55 and 56 are opened and the pump unit 40 is lowered from the vessel by means of the cables 68 and 69 until the pump unit 40 reaches the position as shown in FIG. 7. During the lowering of the pump unit 40 the guide element 72 slides along the cable 67 which is kept in stretched condition during the lowering of the pump unit 40.

The remotely controlled valves 55 and 56 are then closed from the vessel by passing a proper signal and the necessary energy via the electric cables to the valves 55 and 56. After closure of the valves 55 and 56 the pumps 43 and/or 44 are switched on by passing a proper signal and the necessary energy through the electric cables 62 and/or 63. The pump(s) 43 and/or 44 remove water from the interior 50 of the tubular element 35 which is discharged through the outlet(s) 45 and/or 46. In this manner a pressure difference is created between the interior 50 and the exterior of the tubular element 35 which causes the latter to penetrate into the waterbottom.

When the tubular element 35 has penetrated into the waterbottom to the desired depth, the pumps 43 and/or 44 are switched off and the valves 55 and 56 are opened again. Then by means of the hoisting cables 68 and 69 the pumping unit 40 is raised to the water surface and taken aboard of the vessel. If desired the cable 67 can then be used for mooring a floating object such as a vessel or a floating platform to the tubular element 35.

In the above, the tubular element 35 is lowered to the water bottom before the lowering of the pumping unit 40. Instead, it is possible to lower the tubular element 35 and the pumping unit 40 together at the same time.

A tubular element, secured to the bottom of a body of water in the manner according to the invention can be used for various purposes. If it is provided with an anchor cable, it can for example be used for the mooring of a ship, for anchoring a floating production-or drilling platform, so as for example a so-called tension leg platform, for anchoring a single buoy mooring system for loading or unloading tankers.

The said tubular element can also be used as an envelope for protecting the well head and/or the upper part of an oil or gas well in the seabed, or for anchoring a pipeline to the seabed, or for the staying by means of guy cables of various structures, such as for example a freestanding marine conductor.

Figure 8:
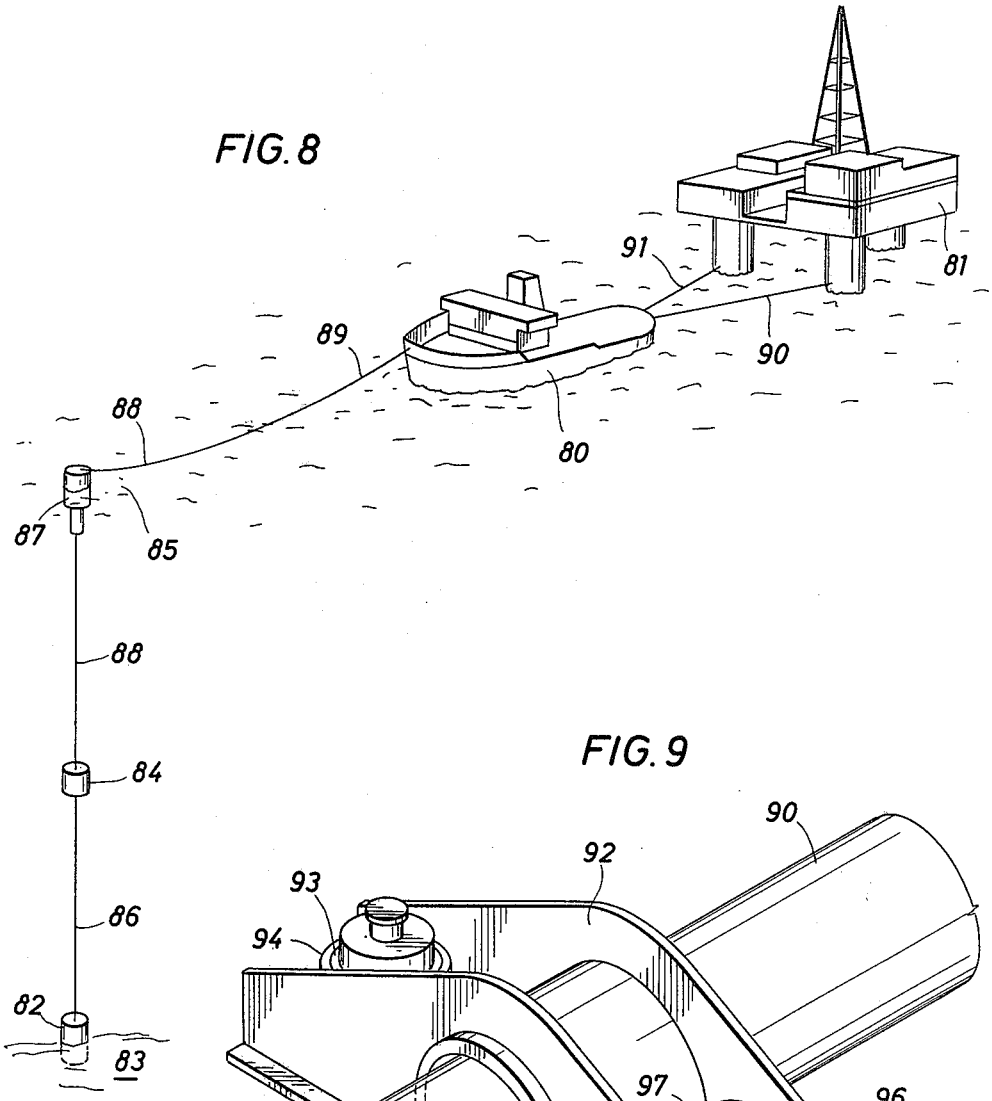
FIG. 8 is a view that shows in perspective the application of the tubular element according to the invention to a supply boat bow mooring system.

An example of a possible application of the apparatus according to the invention is shown in FIG. 8, which discloses a bow mooring system for mooring a supply boat 80 close to an offshore drilling platform 81. In this figure, a tubular element 82, secured to the sea bottom 83 in the manner according to the invention, is used for anchoring an intermediate buoy 84 below the watersurface 85 by means of a chain or cable 86, which interconnects the tubular element 82 and the intermediate buoy 84. A mooring buoy 87 floating at the watersurface 85 is connected to the intermediate buoy 84 by means of a cable or chain 88. The mooring buoy 87 is provided with a mooring line 88 which is adapted to be connected to the mooring hawser 89 of the supply boat 80. The stern of the boat 80 is connected to the platform 81 by means of a pair of mooring lines 90 and 91.

Figure 9:
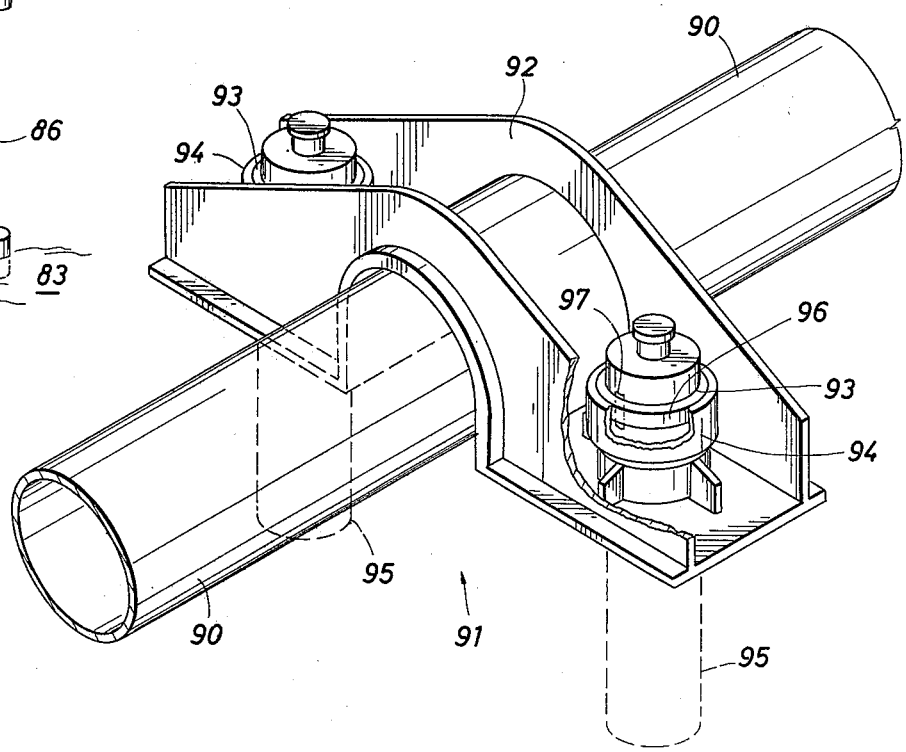
FIG. 9 is an isometric view shows in perspective the application of the tubular element according to the invention to a system for anchoring a pipeline to a waterbottom.

Another field of application of the invention concerns the anchoring of a pipeline to the seabed in the manner as shown in FIG. 9. In FIG. 9, a pipeline 90 is shown which is laying on the seabed 91. In order to anchor the pipeline 90 to the seabed 91 a brace 92 is placed over the pipeline 91. At each end the brace 92 is provided with a bore 93 and a jacket 94. The brace 92 is secured to the seabed by passing through each bore 93 and jacket 94 a tubular element 95 according to the invention. This tubular element 95 is provided with a collar 96 and it is installed and caused to penetrate into the seabed 91 in the manner according to the invention as described in the above.

The jacket 94 is internally provided with a cam 97 which is adapted to cooperate with the collar 96 on the tubular element 95.

FIG. 9 shows the situation after both tubular elements 95 have been installed. The tubular elements 95 anchor the brace 92, firmly to the seabed 91, so that the brace 92 secures the pipeline 90 firmly to the seabed 91. The purpose of the cam 97 is to load the tubular element 95 eccentrically when an upwardly directed force acts on the pipeline 90 and thus on the brace 92.

After the tubular elements 95 have been installed the pumping unit (not shown) of each tubular element 95 is raised to the watersurface and recovered in the manner as explained in the above.

If it is desired to remove the tubular unit from the seabed, it is possible to secure a pumping unit to the tubular element and to create an overpressure within the tubular element causing the tubular element to raise upwardly so that it can be recovered.

The pump used in the pumping unit according to the invention can be of any suitable type, for example centrifugal pump, a positive displacement pump, or even an ejector pump.

I claim as my invention:

1. A method of securing a tubular element in the bottom of a body of water, comprising the steps of lowering the tubular element from the watersurface to the waterbottom and allowing said tubular element to fill completely with water, selectively removably mounting a pumping unit on the tubular element either before or after the lowering of the tubular element through the water to an underwater position of the pumping unit and tubular element on the bottom, closing the tubular element at the upper end, pumping water from said tubular element to reduce the pressure within the tubular element by operating the pumping unit so that the pressure difference of the water outside and within the tubular element causes the tubular element to penetrate into the waterbottom substantially completely, stopping the operation of the pumping unit, disconnecting the pumping unit from the tubular element, raising the pumping unit to the watersurface and recovering it.

2. An apparatus for securing a tubular element in the bottom of a body of water, said apparatus comprising a tubular element which is adapted to be closed at the upper end and which is open at the lower end, cable means extendible from the watersurface to the bottom of the water for lowering the tubular element to the bottom, a thin cutting edge at the lower end of the tubular element, a pumping unit for reducing the pressure within the tubular element, said pumping unit being mounted on the tubular element, a remotely controlled releasable coupling connecting said pumping unit to said tubular element, power transmission cable means connected to said pumping means for supplying power thereto and extending from the watersurface to the pumping unit, hoisting means for raising the pumping unit to the watersurface, and a remotely controlled valve for opening or closing a conduit at the upper end of and in communication between the interior and the exterior of the tubular element.

3. The apparatus as claimed in claim 2, wherein the valve is arranged on the pumping unit.

4. The apparatus as claimed in claim 2, wherein the pumping unit is provided with a filter-or sieve device.

5. The apparatus as claimed in claim 2, wherein the tubular element is provided with an anchor line.

* * * * *